US007300363B2

(12) United States Patent
Kasashima

(10) Patent No.: US 7,300,363 B2
(45) Date of Patent: Nov. 27, 2007

(54) GOLF BALL

(75) Inventor: Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 175 days.

(21) Appl. No.: 11/050,770

(22) Filed: Feb. 7, 2005

(65) Prior Publication Data

US 2006/0178231 A1 Aug. 10, 2006

(51) Int. Cl.
*A63B 37/06* (2006.01)

(52) U.S. Cl. ..... 473/376

(58) Field of Classification Search ..... 473/378, 473/373, 374, 368
See application file for complete search history.

(56) References Cited

U.S. PATENT DOCUMENTS 6,565,455 B2 * 5/2003 Hayashi et al. ..... 473/371

* cited by examiner

*Primary Examiner*—Raeann Trimiew
(74) *Attorney, Agent, or Firm*—Sughrue Mion Pllc.

(57) ABSTRACT

A golf ball is composed of a resilient core, a cover which encloses the core, is made primarily of a polyurethane thermoplastic elastomer and has on a surface thereof 250 to 370 dimples, and at least one intermediate layer disposed between the core and the cover. The core has a center portion and a surface portion that is harder than the center portion, the hardness difference expressed in JIS-C hardness units being in a range of 15 to 30, and has a deflection of 1.8 to 4.0 mm when subjected to an increase in load from an initial load state of 98 N (10 kgf) to a load of 1,275 N (130 kgf). The intermediate layer has a Shore D hardness of 55 to 75, and the cover has a Shore D hardness of 30 to 58. The dimples, which are a combination of at least five types having contour lengths at a dimple edge position in a range of 7 to 20 mm, have a total volume of 400 to 700 $mm^3$ and a surface coverage relative to an overall surface of the ball of at least 79%.

16 Claims, 4 Drawing Sheets

GOLF BALL

BACKGROUND OF THE INVENTION

The present invention relates to multi-piece golf balls having a resilient solid core, a resin cover, and at least one intermediate layer therebetween.

In the past, solid golf balls have been optimized for properties such as core and cover hardness under relatively high-spin conditions (e.g., conditions where the backspin of the ball when hit with a driver is about 3,000 rpm) in order to improve the feel of the ball upon impact and its controllability (so that shots often stop on the green).

However, it was later found that a golf ball hit at a low spin and a high launch angle will travel a longer distance. With recent advances in golfing equipment such as balls and clubs, it is no longer unusual today for a ball hit by a club designed for distance, such as a driver, to have a backspin of 2,000 rpm or less.

Under such low-spin conditions, the ball that has been hit will have a low coefficient of drag, which acts to increase its travel distance. Yet, with the dimples that have hitherto been used in golf balls, the drop due to insufficient lift in the low-speed region after the highest point of the ball's trajectory has resulted in a loss of distance.

SUMMARY OF THE INVENTION

The object of the invention is to provide a golf ball which, through optimization of the ball construction and the construction and arrangement of dimples thereon, does not readily lose lift even in the low-spin region and thus can beneficially increase the distance traveled by the ball.

We have conducted extensive investigations, as a result of which we have found that in multi-piece golf balls which are composed of a resilient solid core enclosed by a resin cover having dimples on the surface, and which also include at least one intermediate layer between the core and cover, by optimizing the relationship between the overall hardness and hardness distribution of the core, the hardness of the intermediate layer and the hardness of the cover, by arranging a combination of multiple types of dimples having relatively large contour lengths at dimple edge positions to a high density on the surface of the ball, and by also optimizing the total volume of the dimples, the flight performance of the ball can be further enhanced, beneficially increasing the distance traveled by the ball, regardless of whether the golfer is an amateur or a professional.

Accordingly, the invention provides the following golf balls.

[1] A golf ball composed of a resilient core, a cover which encloses the core, is made primarily of polyurethane resin and has on a surface thereof 250 to 370 dimples, and at least one intermediate layer disposed between the core and the cover, the golf ball being characterized in that the core is formed with a center portion and a surface portion that is harder than the center portion, the hardness difference expressed in JIS-C hardness units being in a range of 15 to 30, and has a deflection of 1.8 to 4.0 mm when subjected to an increase in load from an initial load state of 98 N (10 kgf) to a load of 1,275 N (130 kgf), the intermediate layer has a Shore D hardness of 55 to 75, the cover has a Shore D hardness of 30 to 58, and the dimples are a combination of at least five types having contour lengths at a dimple edge position in a range of 7 to 20 mm, which dimples have a total volume of 400 to 700 $mm^3$ and a surface coverage relative to an overall surface of the ball of at least 79%.

[2] The golf ball of [1], wherein the core has a JIS-C hardness in the center portion of 57 to 67 and a JIS-C hardness in the surface portion of 80 to 90.

[3] The golf ball of [1], wherein dimples having contour lengths at the dimple edge position in a range of 13 to 20 mm account for at least 70% of the total number of dimples.

[4] The golf ball of [1], wherein the resilient core has a deflection when subjected to an increase in load from an initial load state of 98 N (10 kgf) to a load of 1,275 N (130 kgf) of 2.0 to 3.5 mm.

[5] The golf ball of [1], wherein the intermediate layer is formed so as to have a Shore D hardness which is no more than 25 units higher than the Shore D hardness of the cover.

[6] The golf ball of [1], wherein the core is designed so as to have a hardness that increases gradually from the center portion toward the surface portion thereof.

[7] The golf ball of [1], wherein the cover has a thickness of 0.5 to 1.5 mm.

[8] The golf ball of [1] which, when hit, has a coefficient of lift CL at a Reynolds number of 70,000 and a spin rate of 2,000 rpm that is at least 70% of the coefficient of lift CL at a Reynolds number of 80,000 and a spin rate of 2,000 rpm, and has a drag coefficient CD at a Reynolds number of 180,000 and a spin rate of 2,520 rpm of not more than 0.225.

BRIEF DESCRIPTION OF THE DIAGRAMS

DETAILED DESCRIPTION OF THE INVENTION

The invention is described more fully below in conjunction with the diagrams.

Figure 1:
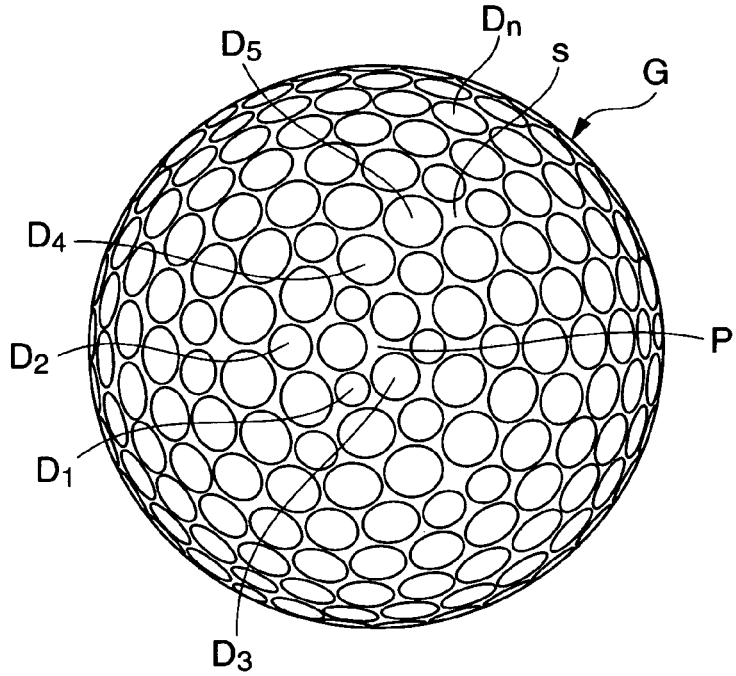
FIG. 1 is a top view showing the surface of a golf ball according to a first embodiment of the invention.
Figure 2:
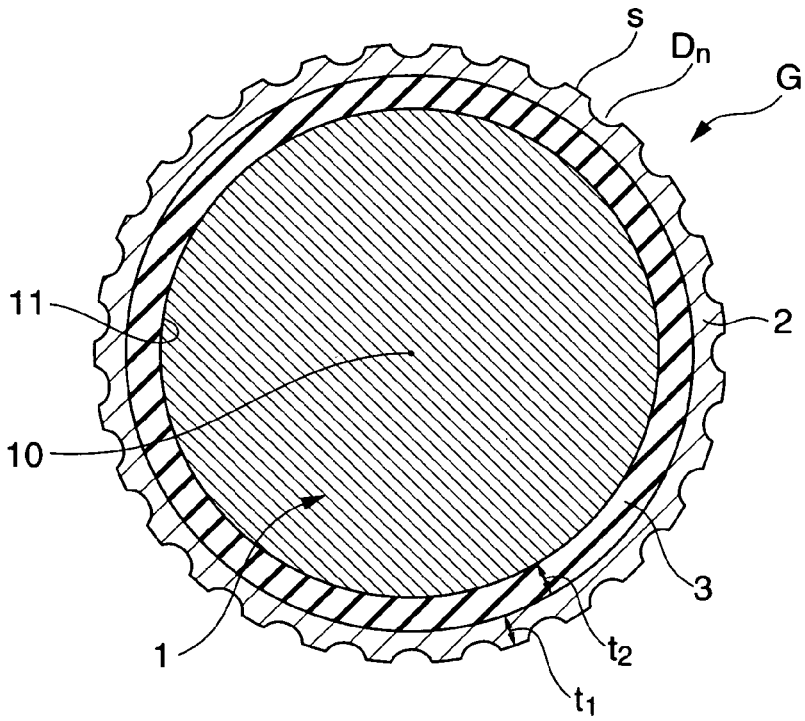
FIG. 2 is a sectional view showing the internal structure (3-layer construction) of a golf ball according to the same embodiment.

FIG. 1 is a top view of a golf ball according to a first embodiment of the invention, and FIG. 2 is a sectional view of the same ball.

Referring to FIGS. 1 and 2, the golf ball of the invention has a resilient core 1 composed of at least one layer, and has a resin cover 2 which encloses the core 1, is made primarily of a thermoplastic polyurethane resin and bears on the surface thereof 250 to 370 dimples. At least one intermediate layer 3 is disposed between the resilient core 1 and the cover 2. As shown in FIG. 2, the resilient core 1 in this first embodiment consists of a single layer.

The resilient core 1 is formed with a center portion 10 and a surface portion 11 that is harder than the center portion 10. The hardness difference therebetween, as expressed in JIS-C hardness units, is 15 to 30, and preferably 17 to 28. At a hardness difference of less than 15, the spin rate of the ball when hit with a driver will be too large. On the other hand, at a hardness difference of more than 28, the core will tend to have a poor durability.

It is preferable for the center portion 10 of the core to have a JIS-C hardness of 57 to 67, and for the surface portion 11 of the core to have a JIS-C hardness of 80 to 90. It is especially preferable for the core to have a hardness distribution such that the hardness increases gradually from the center toward the surface of the core, or radially outward. This resilient core 1 has a deflection, when subjected on a flat plate to an increase in load from an initial load state of 98 N (10 kgf) to a load of 1,275 N (130 kgf), of 1.8 to 4.0 mm, and preferably 2.0 to 3.5 mm. A deflection of less than 1.8 mm will compromise the feel of the ball when hit, whereas a deflection greater than 4.0 mm will lower the rebound of the ball, making it difficult to achieve the object of the invention.

The intermediate layer 3 has a Shore D hardness of 55 to 75, and preferably 60 to 70. The cover 2 has a Shore D hardness of 30 to 58, and preferably 45 to 55. If the Shore D hardnesses of the intermediate layer and the cover are not designed so as to fall within these respective ranges, the ball will have a poor feel upon impact and an inferior flight performance.

In the practice of the invention, it is preferable for the intermediate layer 3 to be formed to a hardness which is not more than 25 Shore D hardness units higher than the hardness of the cover 2. It is especially preferable for this hardness difference to be 25 or less, and even more preferably in a range of 5 to 20.

Figure 5:
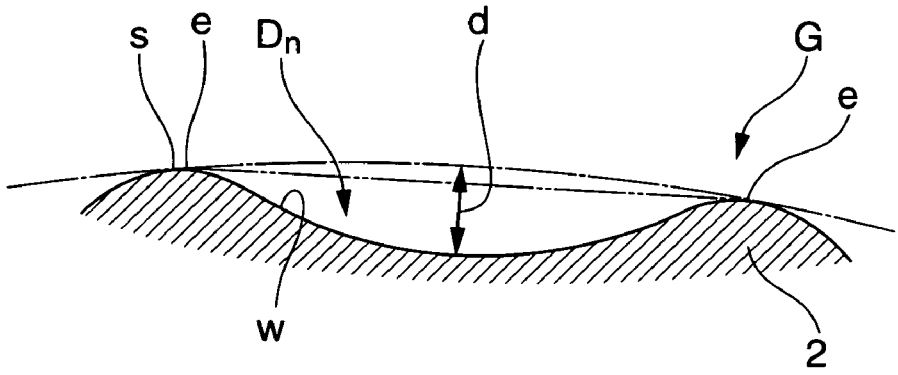
FIG. 5 is an enlarged sectional view of a dimple in the invention.

Next, concerning the dimples in the invention, reference should be made to the enlarged sectional diagram of a dimple shown in FIG. 5. The dimples are used in a combination of at least five types having contour lengths, which correspond to the dimple periphery at the edge position e of the dimple Dn shown in FIG. 5, in a range of 7 to 20 mm. Moreover, the dimples Dn have a total volume of 400 to 700 $mm^3$, and a surface coverage relative to an overall surface of the ball G of at least 79%. It is preferable for dimples with contour lengths at the edge position e of the dimple Dn in FIG. 5 of 13 to 20 mm to account for at least 70% of the total number of dimples. When dimples having large contour lengths such as this are arranged densely so as to account for at least 79% of the surface of the ball and in a good balance, the dimples are used in a combination of, in particular, at least five different types within a contour length range of 7 to 20 mm. There is no upper limit to the number of dimple types. By combining on the surface of the ball a variety of dimples of all lengths, the dimples can be uniformly arranged to a high density and in a good balance. It is also possible to suitably combine dimples Dn of differing depth d. The "surface coverage" of the dimples refers herein to the ratio of the surface area of the plane defined by the straight line (indicated as a double dot-and-dashed line) connecting both edges e of the dimple shown in FIG. 5, summed for all the dimples on the surface of the golf ball, to the total surface area of the ball were it to have no dimples thereon. The surface coverage is set to a value of at least 79%.

In FIG. 5, the single dot-and-dashed line represents an extension of the curved surface at land areas s between the dimples.

In the invention, the number of dimples Dn is preferably set in a range of 250 to 370, and especially 270 to 350.

The "total volume" of the dimples Dn refers herein to the cumulative volume of the region enclosed by the wall w of the dimple Dn shown in FIG. 5 and the curved surface at the land areas s (indicated as a single dot-and-dashed line) for all the dimples on the surface of the ball. In the invention, the total volume of the dimples Dn is set in a range of 400 to 700 $mm^3$, and preferably 450 to 650 $mm^3$.

In the practice of the invention, the dimples Dn are not limited to shapes that are circular as viewed from above, like those shown in FIG. 1. Use may equally well be made of dimples having other suitable shapes, such as polygonal (e.g., having three, four, five, or six sides), dew drop-shaped, or elliptical dimples. Any one or combination of these shapes may be used The cover 2 has a thickness $t_1$ of 0.5 to 1.5 mm, and preferably 0.8 to 1.2 mm. The intermediate layer 3 has a thickness $t_2$ which is preferably set within a range of 0.5 to 3.0 mm. The intermediate layer 3 may be composed of a single layer as shown in FIG. 2, or may be composed of a plurality of layers. The combined thickness of the cover 2 and the intermediate layer 3 is preferably set within a range of 1.0 to 4.5 mm.

Figure 4:
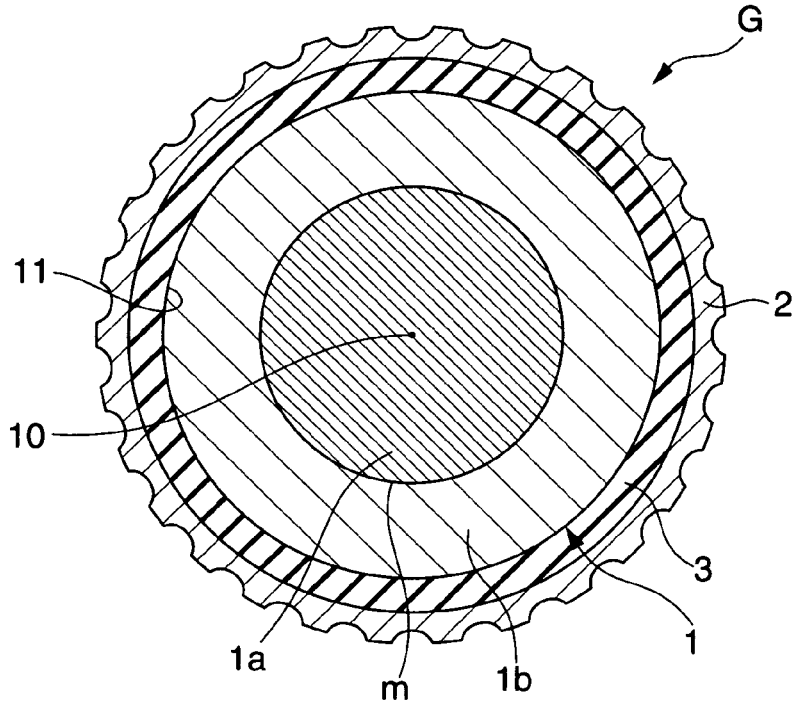
FIG. 4 is a sectional view showing the internal structure (4-layer construction) of a golf ball according to another embodiment of the invention.

FIG. 4 is a sectional view of a golf ball showing a second embodiment of the invention. The second embodiment is characterized in that the resilient core 1 is formed of two layers: an inner layer 1*a* and an outer layer 1*b*. The boundary position m between the inner layer 1*a* and the outer layer 1*b* of the core is not subject to any particular limitation, although in this embodiment it is provided at a position about 60% of the resilient core radius from the center 10 of the core toward the outside 11 of the core. When the resilient core is formed into a plurality of layers in this way, typically by employing a rubber material in the inner layer 1*a* and a resin material in the outer layer 1*b*, the distinctive characteristics of the materials can be utilized to achieve a proper hardness distribution throughout the resilient core. For example, forming the resilient core 1 into three layers enables the hardness of the core to be varied in stages from the inside to the outside thereof.

The resilient core 1 of the inventive golf ball, whether in the inner layer or outer layer, can be formed using rubber formulations containing, for example, known co-crosslinking agents, organic peroxides, inert fillers and organosulfur compounds. This rubber formulation preferably uses polybutadiene as the base rubber. Even when the resilient core has a two-layer structure composed of an inner layer and outer layer as shown in FIG. 4, it is desirable to use polybutadiene rubber in both. Alternatively, insofar as the objects of the invention can be attained, known thermoplastic elastomers and thermoplastic resins can be used as one of these two layers.

The material making up the resin cover 2 in the invention is preferably a polyurethane elastomer. The material making up the intermediate layer 3 in the invention is not subject to any particular limitation, although use can typically be made of a known synthetic resin. More specifically, preferred use can be made of thermoplastic resins or elastomers such as ionomer resins, thermoplastic polyester elastomers, polyurethane resins and thermoplastic polyolefin elastomers.

The effects which act upon a golf ball in flight are explained below for the inventive golf ball of the invention.

Obtaining a ball which, when hit with a club designed for long shots such as a number one wood (driver), has a long travel distance, is particularly resistant to wind effects and provides a good run, requires a suitable balance of lift and drag on the ball that has been hit. This balance depends on the construction of the ball and the materials used in the ball, and also depends on a number of dimple parameters, including the type and total number of dimples, the dimple surface coverage and total volume of the dimples on the ball.

Figure 7:
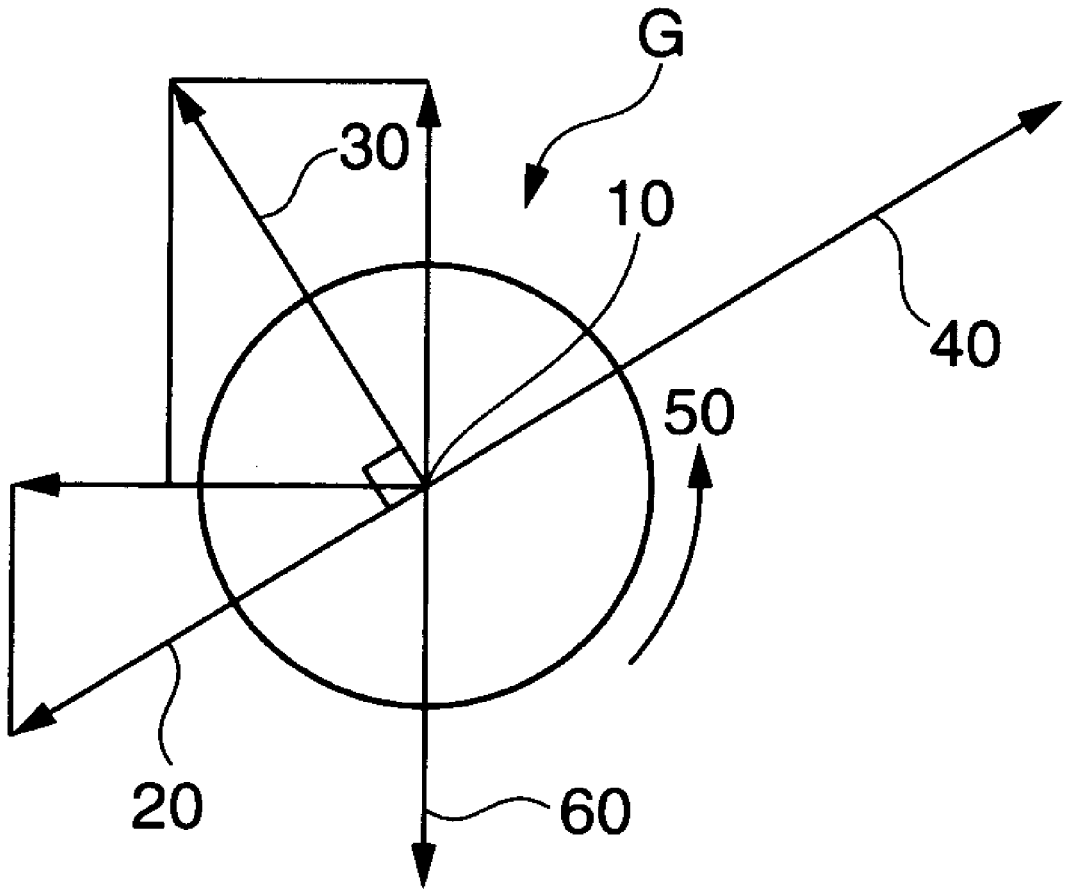
FIG. 7 is a diagram illustrating the relationship between lift and drag on a golf ball in flight.

As shown in FIG. 7, a golf ball in flight that has been hit by a club is known to incur gravity 60, air resistance (drag) 20, and also lift 30 due to the Magnus effect because the ball has spin. Also indicated in the same diagram are the direction of flight 40, the center 10 of the ball, and the direction 50 in which the ball G is spinning.

The forces acting upon the golf ball in this case are represented by the following trajectory equation (1).

$$F=FL+FD+Mg \quad (1)$$

where F: forces acting upon golf ball

FL: lift

FD: drag

Mg: gravity

The lift FL and drag FD in the trajectory equation (1) are given by formulas (2) and (3) below.

$$FL=0.5\times CL\times\rho\times A\times V^2 \quad (2)$$

$$FD=0.5\times CD\times\rho\times A\times V^2 \quad (3)$$

where CL: coefficient of lift

CD: coefficient of drag

ρ: air density

A: maximum cross-sectional surface area of golf ball

V: air velocity with respect to golf ball

To improve the carry of the ball, decreasing the drag or the drag coefficient CD is not that effective by itself. Making only the drag coefficient small will extend the position of the ball at the highest point of the trajectory, but in the low-speed region after the highest point, the ball will drop due to insufficient lift and thus tend to lose carry.

It is preferable for the golf ball of the invention to have a draft coefficient CD at a Reynolds number of 180,000 and a spin rate of 2,520 rpm just after it has been hit of not more than 0.225, and to retain a lift coefficient CL at a Reynolds number of 70,000 and a spin rate of 2,000 rpm just before it reaches the highest point on its trajectory that is at least 70% of its lift coefficient CL at a Reynolds number of 80,000 and a spin rate of 2,000 rpm a little earlier. The Reynolds number of 180,000 just after the ball has been hit corresponds to a ball velocity of about 65 m/s, and the Reynolds numbers of 80,000 and 70,000 correspond respectively to velocities of about 30 m/s and 27 m/s.

The golf ball of the invention can be manufactured by a known method using an injection mold.

When the golf ball is manufactured, the first and/or second row of dimples disposed on the surface of both hemispheres of the ball near the equator thereon which generally coincides with the parting line of the mold halves can be made 5 to 50 μm deeper than dimples of the same type in other areas. At the same time, the dimples in areas near both poles at latitudes of 60° or more on the ball can be made 5 to 50 μm shallower than dimples of the same type in other areas.

Properties of the ball such as its weight and diameter may be set as appropriate according to the Rules of Golf. The ball can generally be formed to a diameter of not less than 42.67 mm and a weight of not more than 45.93 g.

The inventive golf ball thus has a construction made up of a resilient core composed of one or more layers, an intermediate layer and a resin cover, has a specific resilient core hardness distribution and uses a specific type of resin cover material, has optimized intermediate layer and cover hardnesses, and has an optimized dimple construction and dimple arrangement. That is, the golf ball of the invention, through an integral combination of internal features of the ball with the makeup and attributes of the dimples, substantially increases carry and is beneficial for use in competitive play.

EXAMPLES

The following Examples and Comparative Examples are provided by way of illustration and not by way of limitation.

Examples 1 and 2, Comparative Example 1

The golf balls of Examples 1 and 2 had five types of dimples $D_1$ to $D_5$ of differing contour lengths at the dimple edge position arranged thereon as shown in FIG. 1.

Figure 3:
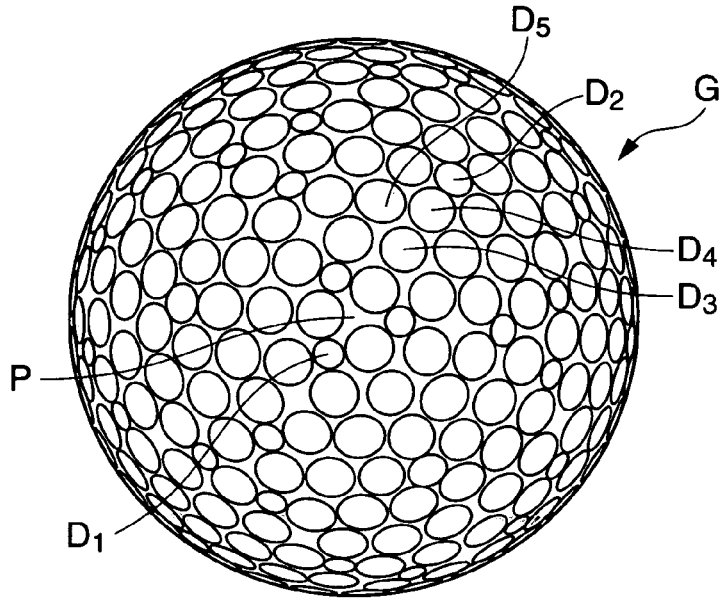
FIG. 3 is a top view showing the surface of a golf ball in a comparative example.

The golf ball of Comparative Example 1 had five types of dimples $D_1$ to $D_5$ of differing contour lengths at the dimple edge position arranged thereon as shown in FIG. 3.

The golf balls in Example 1 and Comparative Example 1 each had a resilient core composed of a single layer; the interior construction of these balls is shown in FIG. 2. The golf ball in Example 2 had a resilient core composed of an inner layer and an outer layer. The interior construction of this ball is shown in FIG. 4.

TABLE 1

| | Type | Diameter (mm) | Contour length (mm) | Depth d (mm) | Volume ($mm^3$) | Number | Total number | Total volume ($mm^3$) | Surface coverage[2)] (%) | Contour length ratio[1)] (%) |
|---|---|---|---|---|---|---|---|---|---|---|
| Dimple I | $D_1$ | 2.5 | 7.9 | 0.115 | 0.279 | 12 | 330 | 553 | 81 | 75 |
| | $D_2$ | 3.5 | 11.0 | 0.136 | 0.558 | 12 | | | | |
| | $D_3$ | 3.8 | 11.9 | 0.140 | 0.726 | 60 | | | | |
| | $D_4$ | 4.4 | 13.8 | 0.147 | 1.048 | 234 | | | | |
| | $D_5$ | 4.6 | 14.5 | 0.146 | 1.138 | 12 | | | | |
| Dimple II | $D_1$ | 2.38 | 7.5 | 0.10 | 0.289 | 60 | 432 | 506 | 80 | 0 |
| | $D_2$ | 2.94 | 9.2 | 0.12 | 0.562 | 12 | | | | |
| | $D_3$ | 3.40 | 10.7 | 0.16 | 1.005 | 12 | | | | |
| | $D_4$ | 3.81 | 12.0 | 0.15 | 1.340 | 60 | | | | |
| | $D_5$ | 3.89 | 12.2 | 0.14 | 1.354 | 288 | | | | |

Notes:

[1)]The ratio of the number of dimples having a contour length of 13 to 20 mm to the total number of dimples, expressed as a percentage (%).

[2)]The ratio of the total surface area of the dimples to the surface area of the ball were it to have no dimples on the surface, expressed as a percentage (%).

Solid Core

Figure 6:
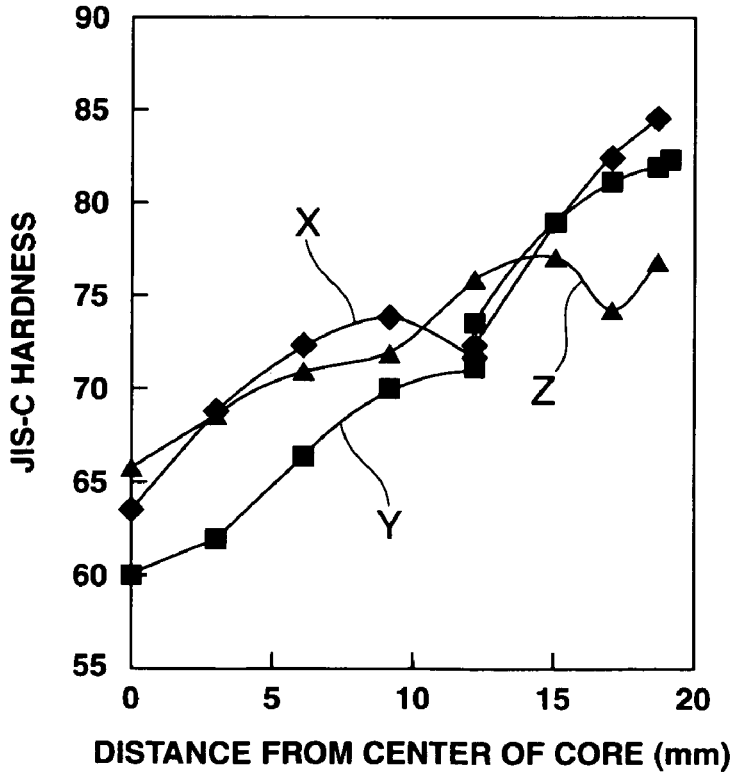
FIG. 6 is a graph showing the relationship between given distances from the center of the core and hardness.

The solid core formulation in Examples 1 and 2 and Comparative Example 1 are shown in the following table. The hardness distributions within the cores in Examples 1 and 2 and Comparative Example 2 are shown in FIG. 6.

TABLE 2

| | Examples according to invention | | | |
|---|---|---|---|---|
| | | 2 | | |
| | 1 | Inner layer | Outer layer | Comparative Example 1 |
| Polybutadiene BR730 | 100 | 100 | 100 | 100 |
| Zinc acrylate | 37 | 27.5 | 31 | 27.5 |
| Zinc oxide | 17.3 | 23.7 | 22.8 | 23.7 |
| Zinc stearate | 5 | 5 | 5 | 5 |
| Zinc pentachlorothiophenol | 2 | 0.2 | 0.2 | 0.2 |
| 2,2'-Methylenebis(4-methyl-6-t-butylphenol) | — | 0.1 | 0.1 | 0.1 |
| Sulfur | 0.1 | — | — | — |
| Dicumyl peroxide | — | 0.3 | 0.3 | 0.3 |
| 1,1-Bis(tert-butylperoxy)cyclohexane, 40% dilution | 3 | 0.3 | 0.3 | 0.3 |

Note:
Numbers in the table indicate parts by weight

Polybutadiene BR730: produced by JSR Corporation
Zinc acrylate: Produced by Nihon Jyoryu Kogyo Co., Ltd.
Zinc oxide: Sakai Chemical Industry Co., Ltd.
Zinc stearate: NOF Corporation
2,2'-Methylenebis(4-methyl-6-t-butylphenol): Produced by Ouchi Shinko Chemical Industry Co., Ltd.

Sulfur: Produced by Tsurumi Chemical industry Co., Ltd.
Dicumyl peroxide: Produced by NOF Corporation
1,1-Bis(t-butylperoxy)cyclohexane, 40% dilution: Produced by NOF Corporation Cover and Intermediate Layer Thermoplastic polyurethane elastomer and ionomer resin were used in Examples 1 and 2 and in Comparative Example 1 as the cover material and the intermediate layer material, respectively. Table 3 gives the various physical properties and travel distance results obtained for each of these golf balls based on the evaluation criteria described below.

Deflection

The amount of deflection by the core when subjected on a hard plate to an increase in load from an initial load state of 98 N (10 kgf) to a load of 1,275 N (130 kgf).

Shore D Hardness

Values measured in accordance with ASTM-D2240 for each material prepared in sheet form.

Low-Speed CL and High-Speed CD Values

The low-speed CL ratio was determined by using an UBL (Ultra Ball Launcher) and calculating from the ball on the trajectory the ratio of the lift coefficient CL of the ball at a Reynolds number of 70,000 and a spin rate of 2,000 rpm with respect to the lift coefficient CL at a Reynolds number of 80,000 and a spin rate of 2,000 rpm. The high-speed CD value was similarly obtained by measuring the drag coefficient at a Reynolds number of 180,000 and a spin rate of 2,520 rpm just after the ball had been hit.

Flight Performance

The carry and total distance traveled by the ball were measured when the ball was hit at a head speed of 45 m/s with a club (W#1) mounted on a swing robot.

TABLE 3

| | | Examples of invention | | Comparative Example |
|---|---|---|---|---|
| | | 1 | 2 | 1 |
| Resilient core | Radius (mm) | 18.65 | 19.11 | 18.65 |
| | Thickness of inner layer (mm) | — | 11.91 | — |
| | Center hardness (JIS-C hardness) | 63.6 | 60.2 | 65.9 |
| | Outer surface hardness (JIS-C hardness) | 84.8 | 82.3 | 76.8 |
| | Surface hardness − center hardness (JIS-C hardness) | +21.2 | +22.1 | +10.9 |
| | Hardness (mm) | 2.89 | 2.97 | 3.05 |
| | Hardness distribution (FIG. 6) | X | Y | Z |
| Intermediate layer | Material | A | A | A |
| | Thickness (mm) | 1.71 | 1.12 | 1.71 |
| | Shore D hardness | 64 | 64 | 64 |
| Cover | Material | B | B | B |
| | Thickness (mm) | 0.99 | 1.12 | 0.99 |
| | Shore D hardness | 54 | 49 | 54 |
| | Dimple types | I | I | II |
| Ball properties | Spin rate on approach shot (rpm) | 6200 | 6400 | 6100 |
| | Spin rate on shot with driver (rpm) | 2600 | 2600 | 2700 |
| | Spin rate difference (rpm) | 3600 | 3800 | 3400 |
| | Low-speed CL ratio | 82 | 82 | 65 |
| | High-speed CD ratio | 0.214 | 0.214 | 0.228 |
| Distance | Carry (m) | 220 | 221 | 219 |
| | Total distance (m) | 236 | 237 | 233 |

Intermediate layer material A: Ionomer resin
Cover material B: Thermoplastic polyurethane resin

The invention claimed is:

1. A golf ball comprising a resilient core, a cover which encloses the core, is made primarily of polyurethane resin and has on a surface thereof 250 to 370 dimples, and at least one intermediate layer disposed between the core and the cover, the golf ball being characterized in that the core is formed with a center portion and a surface portion that is harder than the center portion, the hardness difference expressed in JIS-C hardness units being in a range of 15 to 30, and has a deflection of 1.8 to 4.0 mm when subjected to an increase in load from an initial load state of 98 N (10 kgf) to a load of 1,275 N (130 kgf), the intermediate layer has a Shore D hardness of 55 to 75, the cover has a Shore D hardness of 30 to 58, and the dimples are a combination of at least five types having contour lengths at a dimple edge position in a range of 7 to 20 mm, which dimples have a total volume of 400 to 700 $mm^3$ and a surface coverage relative to an overall surface of the ball of at least 79% which, when hit, has a coefficient of lift CL at a Reynolds number of 70,000 and a spin rate of 2,000 rpm that is at least 70% of the coefficient of lift CL at a Reynolds number of 80,000 and a spin rate of 2,000 rpm, and has a coefficient of drag CD at a Reynolds number of 180,000 and a spin rate of 2,520 rpm of not more than 0.225.

2. The golf ball of claim 1, wherein the core has a JIS-C hardness in the center portion of 57 to 67 and a JIS-C hardness in the surface portion of 80 to 90.

3. The golf ball of claim 1, wherein dimples having contour lengths at the dimple edge position in a range of 13 to 20 mm account for at least 70% of the total number of dimples.

4. The golf ball of claim 1, wherein the resilient core has a deflection when subjected to an increase in load from an initial load state of 98 N (10 kgf) to a load of 1,275 N (130 kgf) of 2.0 to 3.5 mm.

5. The golf ball of claim 1, wherein the intermediate layer is formed so as to have a Shore D hardness which is no more than 25 units higher than the Shore D hardness of the cover.

6. The golf ball of claim 1, wherein the core is designed so as to have a hardness that increases gradually from the center portion toward the surface portion thereof.

7. The golf ball of claim 1, wherein the cover has a thickness of 0.5 to 1.5 mm.

8. The multi-piece solid golf ball of claim 1, which is four piece solid golf ball.

9. A golf ball comprising a resilient core, a cover which encloses the core, is made primarily of polyurethane resin and has on a surface thereof 250 to 370 dimples, and at least one intermediate layer disposed between the core and the cover, the golf ball being characterized in that the core is formed with a center portion and a surface portion that is harder than the center portion, the hardness difference expressed in JIS-C hardness units being in a range of 15 to 30, and has a deflection of 1.8 to 4.0 mm when subjected to an increase in load from an initial load state of 98 N (10 kgf) to a load of 1,275 N (130 kgf), the intermediate layer has a Shore D hardness of 55 to 75, the cover has a Shore D hardness of 30 to 58, and the dimples are a combination of at least five types having contour lengths at a dimple edge position in a range of 7 to 20 mm, which dimples have a total volume of 400 to 700 $mm^3$ and a surface coverage relative to an overall surface of the ball of at least 79%, wherein the number of dimples is in a range of 250 to 330.

10. The golf ball of claim 9, wherein the core has a JIS-C hardness in the center portion of 57 to 67 and a JIS-C hardness in the surface portion of 80 to 90.

11. The golf ball of claim 9, wherein dimples having contour lengths at the dimple edge position in a range of 13 to 20 mm account for at least 70% of the total number of dimples.

12. The golf ball of claim 9, wherein the resilient core has a deflection when subjected to an increase in load from an initial load state of 98 N (10 kgf) to a load of 1,275 N (130 kgf) of2.0 to 3.5 mm.

13. The golf ball of claim 9, wherein the intermediate layer is formed so as to have a Shore D hardness which is no more than 25 units higher than the Shore D hardness of the cover.

14. The golf ball of claim 9, wherein the core is designed so as to have a hardness that increases gradually from the center portion toward the surface portion thereof.

15. The golf ball of claim 9, wherein the cover has a thickness of 0.5 to 1.5 mm.

16. The multi-piece solid golf ball of claim 9, which is four piece solid golf ball.

* * * * *

UNITED STATES PATENT AND TRADEMARK OFFICE

CERTIFICATE OF CORRECTION

PATENT NO. : 7,300,363 B2
APPLICATION NO. : 11/050770
DATED : November 27, 2007
INVENTOR(S) : Atsuki Kasashima It is certified that error appears in the above-identified patent and that said Letters Patent is hereby corrected as shown below:

At column 6, line 47, replace Table 1 with the following table:

TABLE 1

| | Type | Diameter (mm) | Contour length (mm) | Depth d (mm) | Volume (mm³) | Number | Total number | Total volume (mm³) | Surface coverage[a] (%) | Contour length ratio[b] (%) |
|---|---|---|---|---|---|---|---|---|---|---|
| Dimple I | $D_1$ | 2.5 | 7.9 | 0.115 | 0.969 | 12 | 330 | 561 | 81 | 75 |
| | $D_2$ | 3.3 | 11.0 | 0.136 | 0.904 | 12 | | | | |
| | $D_3$ | 3.8 | 11.9 | 0.140 | 1.207 | 60 | | | | |
| | $D_4$ | 4.4 | 13.8 | 0.147 | 1.313 | 234 | | | | |
| | $D_5$ | 4.6 | 14.5 | 0.148 | 2.171 | 12 | | | | |
| Dimple II | $D_1$ | 2.38 | 7.5 | 0.10 | 0.299 | 60 | 432 | 506 | 80 | 0 |
| | $D_2$ | 2.94 | 9.2 | 0.12 | 0.562 | 12 | | | | |
| | $D_3$ | 3.40 | 10.7 | 0.16 | 1.005 | 12 | | | | |
| | $D_4$ | 3.81 | 12.0 | 0.15 | 1.340 | 60 | | | | |
| | $D_5$ | 3.89 | 12.2 | 0.14 | 1.354 | 288 | | | | |

Signed and Sealed this

Tenth Day of March, 2009

John Doll

JOHN DOLL
*Acting Director of the United States Patent and Trademark Office*